US007407428B2

(12) United States Patent
Fildan et al.

(10) Patent No.: US 7,407,428 B2
(45) **Date of Patent: *Aug. 5, 2008**

(54) BRASSIERE WITH SOFT/HARD UNDERWIRE ASSEMBLY

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/546,944

(22) Filed: Oct. 12, 2006

(65) Prior Publication Data

US 2007/0087660 A1 Apr. 19, 2007

Related U.S. Application Data

(63) Continuation-in-part of application No. 11/251,573, filed on Oct. 14, 2005, now Pat. No. 7,234,994.

(51) Int. Cl.
*A41C 3/10* (2006.01)
*A41C 3/12* (2006.01)

(52) U.S. Cl. ..... 450/41; 450/43

(58) Field of Classification Search ..... 450/45–56, 450/41, 43; 2/251–253
See application file for complete search history.

(56) References Cited

U.S. PATENT DOCUMENTS

| | | | | |
|---|---|---|---|---|
| 2,595,088 | A * | 4/1952 | Licht | 450/52 |
| 3,562,802 | A * | 2/1971 | Avis | 450/52 |
| 6,346,028 | B1 * | 2/2002 | Fildan et al. | 450/41 |
| 6,447,365 | B1 * | 9/2002 | Powell et al. | 450/41 |
| 7,234,994 | B2 * | 6/2007 | Fildan et al. | 450/41 |

* cited by examiner

*Primary Examiner*—Gloria Hale
(74) *Attorney, Agent, or Firm*—Andrew Wilford

(57) ABSTRACT

A brassiere has a pair of cups each provided with a respective underwire assembly each having inner and outer U-shaped hard underwire portions extending substantially parallel to each other below a respective cup of the brassiere, joined together at ends, and separated by an arcuate slot between the ends. The underwire formed by the two portions is upwardly arcuately concave so as to conform to the contour of a breast in the cup, and is also horizontally arcuately concave so as to conform to the contour of the chest of a wearer of the brassiere. The underwire is embedded in a soft plastic body having an apron along a concave side of the body lying at an angle to the hard underwire portions so that the body and the underwire form a pocket receiving a breast of the wearer in the cup.

6 Claims, 1 Drawing Sheet

BRASSIERE WITH SOFT/HARD UNDERWIRE ASSEMBLY

CROSS REFERENCE TO RELATED APPLICATION

This application is a continuation-in-part of application Ser. No. 11/251,573 filed 14 Oct. 2005 (now U.S. Pat. No. 7.234.994).

FIELD OF THE INVENTION

The present invention relates to a brassiere having a soft/hard underwire assembly with a dual (i.e. soft/hard) character.

BACKGROUND OF THE INVENTION

The use of an underwire as part of a brassiere frame has become common. The underwire, of metal, plastic-coated metal or plastic generally is received in a tubular pocket below each cup and lies along the sternum of the wearer substantially at the junction of the breast with the chest wall. Each cup is provided with such an underwire that maintains the configuration of the cup and contributes the support of the breast.

In the past, problems have been encountered with such underwires. For example some underwire designs tended to poke through the fabric or to shift in the fabric pocket that was provided. In addition, the pull on the underwire when the brassiere is fastened, because of the tension applied around the back of the wearer, tended to spread the underwire that generally had a U- or C-shape.

Frequently the stiffness of the underwire rendered the brassiere uncomfortable and often the lack of ability of the underwire to deform out of its plane caused discomfort as well. When efforts were made in the past to make the underwire more flexible, it tended to lose its stabilizing function.

Furthermore, techniques for inserting the underwire, anchoring the underwire or generally assembling an underwire to the cup and other structures of the brassiere made fabrication complex and expensive. In particular, the tension on the underwire when the brassiere was tightened around the back of the wearer could not be counteracted in the past except by making the wiring so stiff that its breast-shaping and supporting function was defeated.

An effort to overcome at least some of these disadvantages is found in U.S. Pat. No. 6,447,365 that describes a brassiere that ultimately was found to be impractical because of the stiffness of the armature embedded in the softer surround.

In our above-cited copending application we describe a an underwire assembly adapted to be incorporated into a brassiere and comprising:

a generally flat U-shaped hard underwire adapted to be positioned in a brassiere below a cup thereof and along the chest of a wearer, the underwire being formed with two parallel arcuate portions joined at respective ends and separated by an arcuate slot between the ends; and a soft plastic body in which the hard underwire is partially embedded, ensheathing the hard underwire along a bottom of the body and having an apron along a concave side of the body lying at an angle to a plane of the hard underwire so that the body and the underwire form a pocket receiving a breast of the wearer in the cup.

Such an underwire assembly has proven extremely popular. The comfort of the brassiere is, however, greatly affected by the underwire that, under any circumstances, is the most rigid part of the brassiere.

OBJECTS OF THE INVENTION

It is therefore an object of the present invention to provide an improved underwire assembly for a brassiere.

Another object is the provision of such an improved underwire assembly for a brassiere that overcomes the above-given disadvantages, in particular that ensures such a fit that the brassiere can be worn comfortably all day.

SUMMARY OF THE INVENTION

A brassiere according to the invention has a pair of cups each provided with a respective underwire assembly. Each such assembly has inner and outer U-shaped hard underwire portions extending substantially parallel to each other below a respective cup of the brassiere, joined together at ends, and separated by an arcuate slot between the ends. According to the invention the underwire formed by the two portions has a shaped that, in an unstressed or relaxed condition, is arcuately concave in a first upward direction so as to conform to the contour of a breast in the cup, and is also arcuately concave in a second horizontal direction transverse to the first direction so as to conform to the contour of the chest of a wearer of the brassiere. The underwire is embedded in a soft plastic body having an apron along a concave side of the body lying at an angle to the hard underwire portions so that the body and the underwire form a pocket receiving a breast of the wearer in the cup.

Thus according to the invention the underwire has two separate curvatures, each generally determined by one of the two sizes—back and cup—of the brassiere to which it is applied. Thus the underwire for an A cup will have a much smaller radius of curvature for its upward or first curvature than for a D cup, and similarly an underwire for a size-40 brassiere will have a larger radius of curvature of for its rearward or second curvature than for a size-34 brassiere. The result is an underwire that sits flatly against the user without deformation, unlike the prior-art systems there the underwire is planar and must deform to fit against the wearer's chest so that it bears with greater pressure in the center than at the ends.

According to the invention the underwire portions are unitarily formed from a plastic. A polyamide may be used, in particular on incorporating glass beads. In addition the underwire portions are connected together by integral spaced webs bridging the slot.

The angle of the apron corresponds substantially to an angle at which a breast to be supported with the assembly adjoins the chest. Furthermore the apron is provided with an array of throughgoing slits substantially perpendicular to the hard plastic underwire.

The outer arcuate portion in accordance with the invention is formed along its length thereof with segments of alternatingly greater and lesser thickness.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2, 3, 4, 5:
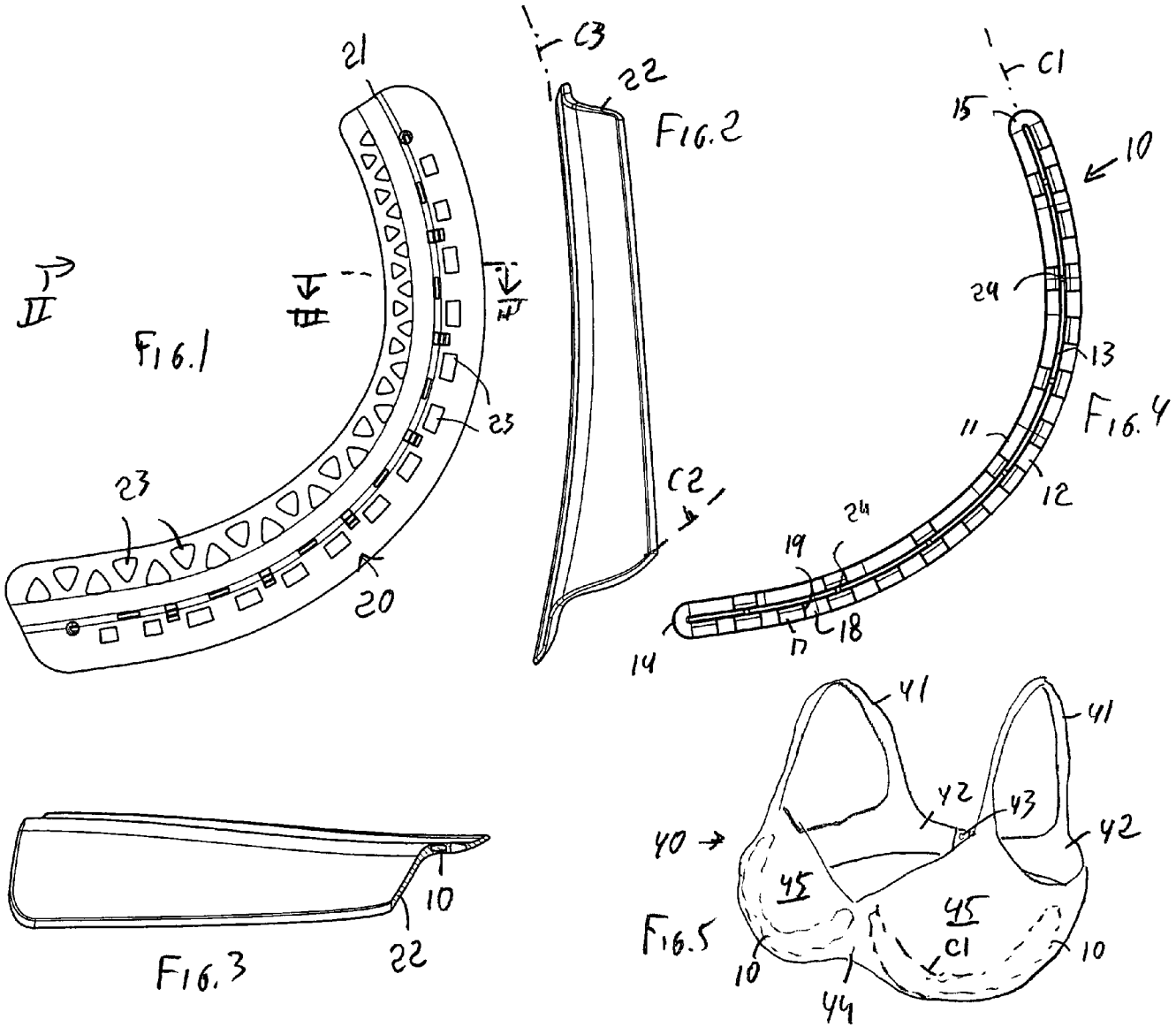
FIG. 1 is a front view of the underwire assembly according to the invention.
FIG. 2 is a are side view taken in the direction of arrows II of FIG. 1 of the assembly.
FIG. 3 is a horizontal section taken along line III-III of FIG. 1.
FIG. 4 is a front view of the underwire.
FIG. 5 is a small-scale view of a brassiere incorporating the underwire in accordance with the invention.

As seen in FIGS. 1-4 an underwire 10 (FIG. 4) that can be formed of a relatively hard plastic, e.g. polyamide-6,6 or nylon 6,6, a basically flat configuration and comprises an inner arcuate element or portion 11 at the concave side of the generally U-shaped underwire 10 and an outer portion or element 12 parallel to the inner element 11 and located on the convex side of the underwire 10. An arcuate slit or slot 13 is provided between these two parallel elements that are connected at rounded ends 14 and 15. The outer element can be formed with successive regions 17 and 18 alternately of lesser and greater thickness so that steps 19 are formed between these regions 17 and 18 and serve as stops when the underwire is embedded in the soft body to prevent that underwire from shifting in the body in which it is sheathed.

Because one or the other of the arcuate portions 11 and 12 can swing relative to another portion, that wire 10 has been referred to as a swing wire and has the properties described in the commonly owned copending application Ser. No. 11/232,424, filed 21 Sep. 2005 that is hereby incorporated in its entirety by reference. To this end small webs 24 extend transversely between the underwire portions 11 and 12 that allow this swinging action while still holding them together.

As shown in FIG. 5, two of the underwires 10 according to the invention are employed in a brassiere 40 comprising shoulder straps 41, a pair of back straps 42 connected by a fastener 43 and a brassiere structure 44 comprising two fabric cups 45, under each of which is embedded a respective underwire 10.

According to the invention the wire 10 has three curvatures C1, C2, and C3. The curvature C1 is concave upward and is dimensioned, that is has a radius, determined by the size of the breast in the respective cup 45. The curvature C2 is in a vertical plane generally perpendicular to the curvature C1 and serves to support and hold the breast. The curvature C3 (FIG. 2) is concave rearward toward the chest of a wearer of the brassiere 40 incorporating the underwire assembly 10 and is determined by chest size. Hence the underwire assembly sits flatly against the chest of the wearer underneath the breast. The curves C1 and C3 are formed by the hard material of the underwire 10 and the curve C2 by the softer front flange or apron. C2 serves to keep C1 in shape, that is to balance or counter the stress on the back wings caused by the weight of the breast. Thus the curvature C1 lies in a generally vertical plane, is open upward, and is determined by the diameter of the breast or cup size. The curvature C2 lies in a generally vertical plane, is open upward, and is generally perpendicular to curvature C1. The curvature C3 lies in a generally horizontal plane, is concave backward toward the wearer of the brassiere, and is determined by the size of the chest or rib cage.

The underwire 10 of this invention is not incorporated directly in the brassiere 40 but is fully embedded in a soft body 20 composed for example of polyurethane with a Shore hardness A of 80 to 90. The body 20 has an arcuate portion 21 in which the underwire is ensheathed and an apron 22 that lies at an angle to the plane of the portion 21 and itself forms a pocket that fits around the breast so that the breast can nestle in that pocket. The apron 22 may be formed with spaced apart windows 23 through which a cover fabric can be ultrasonically welded to the hard plastic underwire therein and slits may be provided in the body at for example 24 to increase the flexibility. These slits are formed along the slot 13 of the fully embedded underwire.

The body 20 in which the underwire 10 is embedded is held between fabric layers forming the brassiere body 44. An inner layer of the fabric also defines the inner surface of the cups 45. No wire channel is needed because the wire construction is one part or layer of the different layers of fabrics that are stitched or otherwise laminated together.

We claim:

1. In combination with a brassiere having a pair of cups, a pair of underwire assemblies each comprising:

inner and outer U-shaped hard underwire portions extending substantially parallel to each other along a lower edge of a respective cup of the brassiere, joined together at ends, and separated by an arcuate slot between the ends, the portions being upwardly arcuately concave so as to conform to the contour of a breast in the cup and horizontally arcuately concave so as to conform to the contour of the chest of a wearer of the brassiere; and a soft plastic body in which both of the hard underwire portions are embedded and having an apron along a concave side of the body lying at an angle to the hard underwire portions and with an upward curvature in a plane transverse to the wire so that the body and the underwire form a pocket receiving a breast of the wearer in the cup.

2. The underwire assembly defined in claim 1 wherein the underwire portions are unitarily formed from a plastic.

3. The underwire assembly defined in claim 2 wherein the underwire portions are connected together by integral spaced webs bridging the slot.

4. The underwire assembly defined in claim 2 wherein the angle corresponds substantially to an angle at which a breast to be supported with the assembly adjoins the chest.

5. The underwire assembly defined in claim 4 wherein the apron is provided with an array of throughgoing slits substantially perpendicular to the hard plastic underwire.

6. The underwire assembly defined in claim 4 wherein the outer arcuate portion is formed along its length with segments of alternatingly greater and lesser thickness.

* * * * *